United States Patent [19]

Hisatomi et al.

[11] Patent Number: 5,026,294

[45] Date of Patent: Jun. 25, 1991

[54] IGNITION PLUG SOCKET STRUCTURE

[75] Inventors: Masahiro Hisatomi, Kanagawa; Yoshihiro Togasaki, Hyogo; Mitsuyasu Tanaka, Shizuoka, all of Japan

[73] Assignees: Nissan Motor Co., Ltd.; Hanshin Electric Co., Ltd.; Yazaki Corporation, all of Japan

[21] Appl. No.: 486,929

[22] Filed: Mar. 1, 1990

[30] Foreign Application Priority Data

Mar. 3, 1989 [JP] Japan ..... 1-24397[U]

[51] Int. Cl.[5] ..... H01R 11/11; H01R 13/631

[52] U.S. Cl. ..... 439/125; 439/374

[58] Field of Search ..... 439/125-128, 439/374, 248, 252

[56] References Cited

U.S. PATENT DOCUMENTS 4,671,586 6/1987 DeBolt ..... 439/126
4,884,977 12/1989 Sturdevan ..... 439/125

FOREIGN PATENT DOCUMENTS 2501425 9/1982 France ..... 439/374
2618265 1/1989 France ..... 439/374

*Primary Examiner*—Gary F. Paumen
*Attorney, Agent, or Firm*—Wigman & Cohen

[57] ABSTRACT

To facilitate mounting the ignition plug socket into a socket mounting hole formed in an engine body and additionally to prevent vibration of the mounted plug socket, a plurality of projections such as axially extending straight ribs or circumferentially extending annular ribs are formed on the outer circumferential surfaces of the plug socket body of the ignition plug socket.

4 Claims, 10 Drawing Sheets

IGNITION PLUG SOCKET STRUCTURE

BACKGROUND OF THE INVENTION

1. Field of the Invention

The present invention relates to an ignition plug socket structure for connecting an ignition plug provided for an internal combustion engine to an ignition coil for generating a high tension via a high tension cord, and more specifically to an ignition plug socket structure easy to be connected to the ignition plug and difficult to be vibrated after having been connected to the ignition plug.

2. Description of the Prior Art

In general, an ignition plug socket is used to supply a high tension generated by an ignition coil to an ignition plug provided for an automotive vehicle. In this case, an ignition plug socket is attached to one end of a high tension cord, and a female plug socket terminal provided at one end of the plug socket is mated with a male ignition plug terminal provided within a hole formed in an engine body.

In more detail, with reference to FIG. 1, an ignition plug 1 having an ignition electrode (not shown) and projecting into a combustion chamber (not shown) is fixed via thread to a bottom of an ignition plug socket mounting hole 2 formed in an engine body 3. An insulating plug socket protective cover 4 is disposed on the inner circumference of this plug socket mounting hole 2, and an ignition plug terminal 7 is fixed to the ignition plug 1.

On the other hand, an ignition plug socket 20A comprises an ignition plug socket body 9, and a plug socket terminal 5 provided within the plug socket body 9 and connected to one end of a noise prevention high tension cord 6 whose other end is connected to an ignition coil (not shown). This plug socket terminal 5 is mated with the ignition plug terminal 7 near the internal end of the ignition plug socket 20A. Further, an upper rubber cap 10 formed with a socket mounting groove 11 is attached to top of the ignition plug socket 20A to hold and guide the high tension cord 6.

Therefore, when the ignition plug socket 20A is mounted on the engine body to connect the high tension cord 6 to the ignition plug 1, the ignition plug socket 20A is inserted into the plug socket mounting hole 2 via the insulating plug socket protective cover 4 so that the plug socket terminal 5 is engaged with the ignition plug terminal 7 at the internal end of the plug socket 20A and simultaneously the socket mounting groove 11 is engaged with the top end of the plug socket protective cover 4 at the external end of the plug socket 20A.

In the prior-art ignition plug socket 20A, however, since the plug socket mounting hole 2 is relatively deep, there exists a problem in that it is difficult to connect the socket terminal 5 with the ignition plug terminal 7, that is, to align the axial center of the plug socket 20A with that of the ignition plug 1. This is because the lower end of the plug socket body 9 tends to be brought into contact with the upper end of the ignition terminal 7 of the ignition plug 1. In addition, in the prior-art ignition plug socket 20A, since the ignition plug socket 20A is fixed to the engine body 3 at only the external position (where the plug socket protective cover 4 is engaged with the socket mounting groove 11 of the upper rubber cap 10) and the inner position (where the socket terminal 5 is engaged with the plug terminal 7), there exists another problem in that after the plug socket 20A has been mounted on the engine, vibration is directly transmitted to the plug socket when the engine is running or the vehicle is travelling, so that the plug socket 20A is damaged or removed from the engine body 3.

SUMMARY OF THE INVENTION

With these problems in mind, therefore, it is the primary object of the present invention to provide an ignition plug socket structure easy to be inserted into the socket mounting hole and difficult to be vibrated during engine running or vehicle travelling.

To achieve the above-mentioned object, the ignition plug socket structure mounted on an engine body, for connecting an ignition coil to an ignition plug, according to the present invention, comprises: (a) an ignition plug socket for holding a plug socket terminal therewithin; and (b) said ignition plug socket being formed with a plurality of projection portions brought into direct or indirect contact with an inner circumferential surface of an ignition plug socket mounting hole formed in the engine body. A plurality of the projection portions of said ignition plug socket are brought into indirect contact with said inner circumferential surface of the ignition plug socket mounting hole via a plug socket protective cover. The ignition plug socket comprises: (a) a plug socket body (25) for holding a plug socket terminal (21) therewithin; (b) a first cap (26) attached to a first end of said plug socket body; and (c) a second cap (28) attached to a second end of said plug socket body, said second cap being formed with a plurality projection portions brought into contact with an inner circumferential surface of the plug socket protective cover.

The second cap is a lower rubber cap (28) formed with a plurality of axially extending straight ribs (**28*b*) or circumferentially extending annular ribs (28B) formed on an outer circumferential surface of the lower rubber cap. Further, it is preferable that the first cap is further formed with a plurality of the similar projection portions. That is, the first cap is an upper rubber cap (26) formed with a plurality of axially extending straight ribs (26*d*) or circumferentially extending annular ribs (26D**) formed on an outer circumferential surface of the upper rubber cap.

In the ignition plug socket structure according to the present invention, since a plurality of projection portions (such as axially extending straight ribs or circumferentially extending annular ribs) are formed in either or both the outer circumferential surfaces of the upper and lower rubber caps attached to the plug socket body, so as to be brought into contact with an inner circumferential surface of the plug socket mounting hole or the plug socket protective cover, when and after the ignition plug socket has been mounted on the engine body into contact with the ignition plug, it is possible to easily align the axis of the ignition plug socket and that of the socket mounting hole, so that the plug socket terminal can be easily brought into contact with the plug terminal. In addition, since these projection portions are kept in contact with the socket protective cover inserted into a plug socket mounting hole formed in the engine body, it is possible to effectively present the mounted ignition plug socket from being vibrated when the engine is running or the vehicle is travelling.

BRIEF DESCRIPTION OF THE DRAWINGS

The features and advantages of the ignition plug socket structure according to the present invention will be more clearly appreciated from the following description taken in conjunction with the accompanying drawings in which like reference numerals designate similar corresponding elements and in which.

DETAILED DESCRIPTION OF THE PREFERRED EMBODIMENTS

Figure 1:
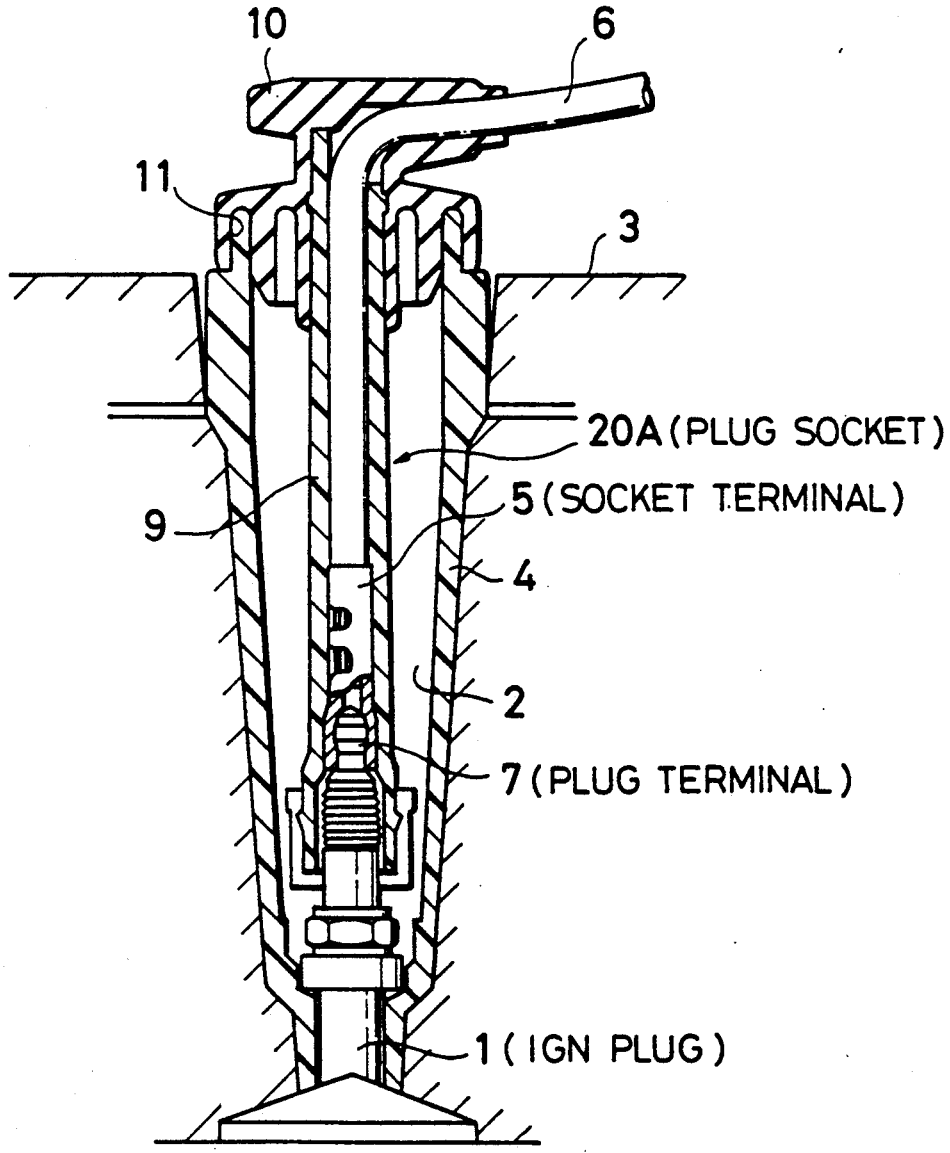
FIG. 1 PRIOR ART
FIG. 1 is a longitudinal cross-sectional view showing a prior-art ignition plug socket structure.
Figure 2A:
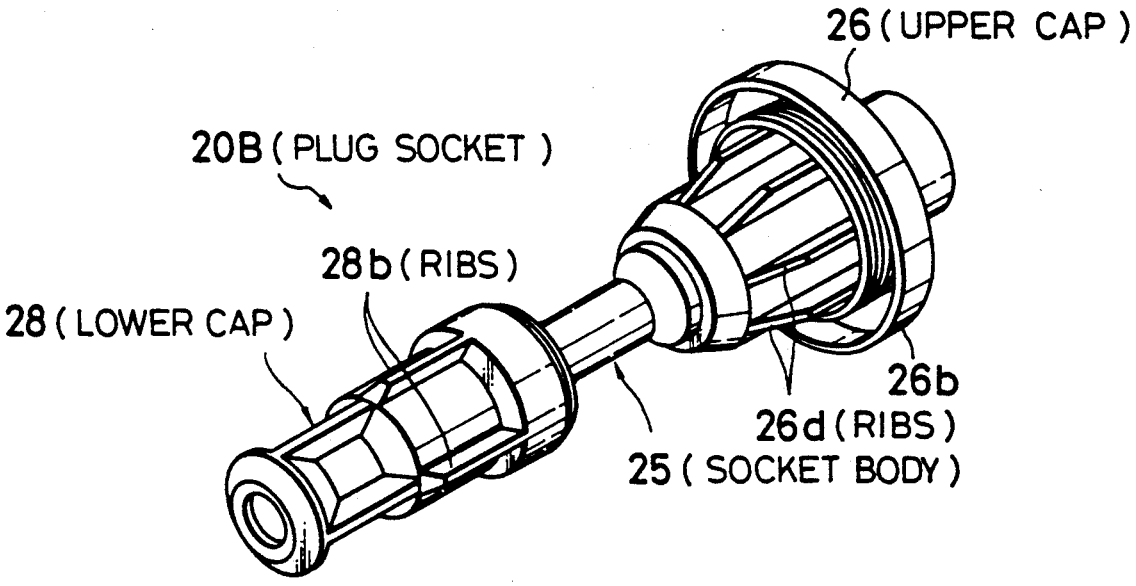
FIG. 2(A) is a perspective view showing a first embodiment of the ignition plug socket structure according to the present invention.
Figure 2B:
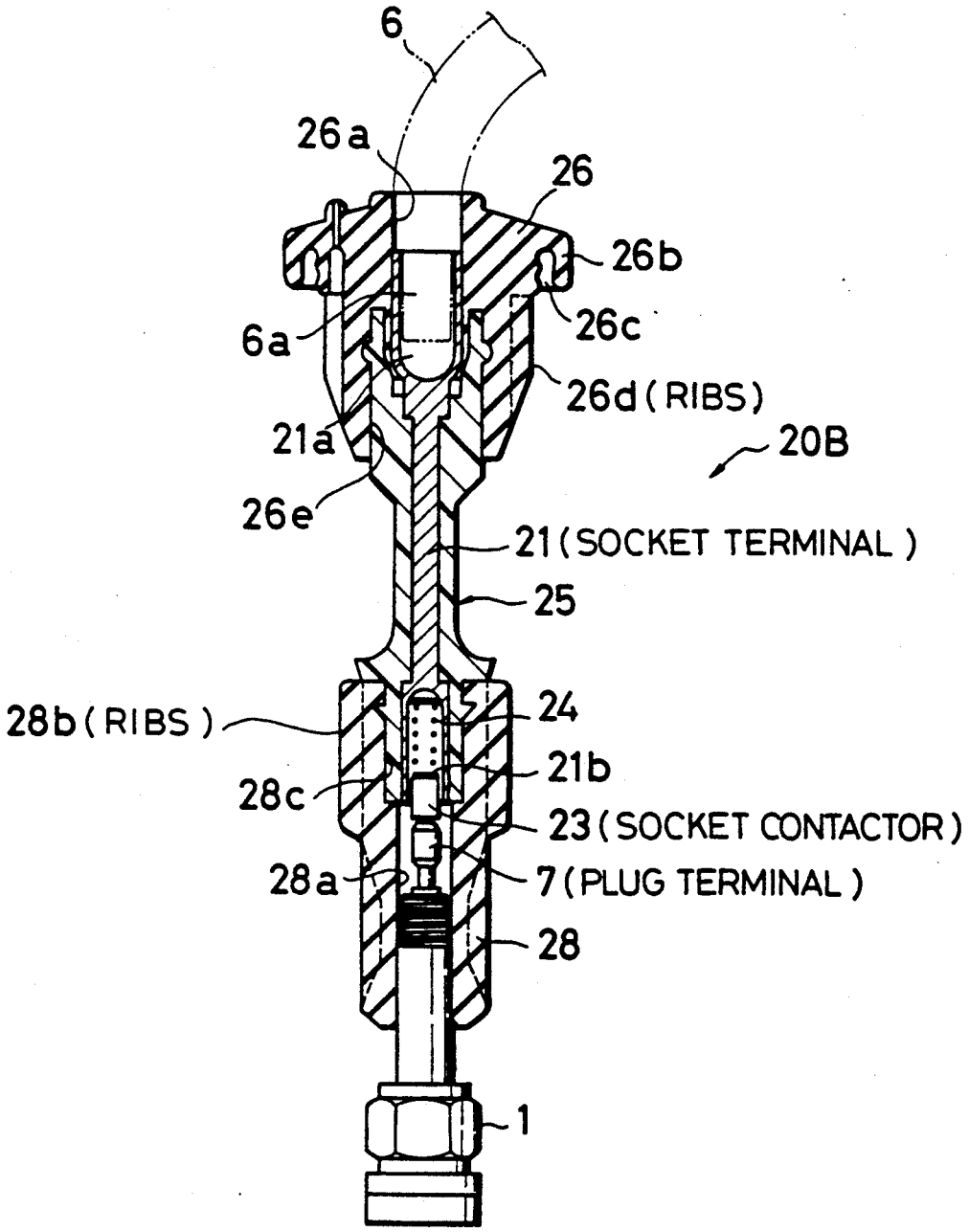
FIG. 2(B) is a longitudinal cross-sectional view showing the first embodiment shown in FIG. 2(A)

The ignition plug socket structure according to the present invention will be described in more detail hereinbelow with reference to the attached drawings. FIGS. 2(A) and 2(B) show a first embodiment of the present invention.

In FIG. 2(A) the ignition plug socket 20B of the present invention comprises roughly a cylindrical socket body 25 made of an insulating resin, an upper cap 26 made of rubber and a lower cap 28 also made of rubber. The features of the plug socket 20B according to the present invention is to form a plurality of axially extending straight ribs 26*d* on the outer circumference of the upper rubber cap 26 and also to form a plurality of similar axially extending straight ribs 28*b* on the outer circumference of the lower rubber cap 28. These ribs 26*d* and 28*b* serve to allow the plug socket 20B to be automatically located at the center of a socket mounting hole formed in an engine body so as to be aligned with the axial center of an ignition plug, when the plug socket 20B is inserted into the socket mounting hole formed in the engine body. In addition, these ribs 26*d* and 28*d* serve to prevent the mounted plug socket 20B from being vibrated during engine running or vehicle travelling.

The construction of the plug socket 20B will be described in further detail with reference to FIG. 2B. Within the cylindrical socket body 25, a rod-shaped conductive (e.g. copper made) socket terminal 21 is disposed by insertion molding. This socket terminal 21 is formed with an upper cylindrical hollow portion 21*a* to which a high tension cord 6 is connected, and a lower cylindrical hollow portion 21*b* in which a socket contactor 23 (e.g. carbon made) of the plug socket 20B is supported by a spring 24 to construct a plug socket terminal end. This socket contactor 23 is brought into contact with a plug terminal 7 of an ignition plug 1, when the plug socket 20B is mounted on an engine body.

As shown in FIG. 2(B), the upper rubber cap 26 is formed with a small-diameter central hole 26*a*, a large-diameter center hole 26*e*, a fitting flange 26*b*, a fitting groove 26*c*, and the afore-mentioned axially extending straight ribs 26*d*. The upper end of the rod-shaped conductive socket terminal 21 and the outer sheath of the high tension cord 6 are pressure fitted to the small diameter central hole 26*a* of the upper rubber cap 26. The upper end of the cylindrical socket body 25 is pressure fitted to the large diameter central hole 26*e* of the upper rubber cap 26. Further, a conductive spiral wire (not shown) wound around a core 6*a* of the high tension cord 6 is pressure fitted to the upper cylindrical hollow portion 21*a* into electric contact with the socket terminal 21. Further, the lower rubber cap 28 is formed with a small-diameter central hole 28*a*, a large-diameter central hole 28*c*, and the afore-mentioned axially extending straight ribs 28*b*. The lower end of the cylindrical socket body 25 is pressure fitted to the large diameter central hole 28*c*, and the upward end of the ignition plug 1 is loosely fitted into the small-diameter central hole 28*a*.

The function of the ribs 26*d* and 28*b* will described hereinbelow with reference to FIGS. 3(A) and (B). When the ignition plug socket 20B thus constructed is inserted into a socket mounting hole 2 formed in the engine body 3 to bring the socket contactor 23 into contact with the plug terminal 7, first only the lower rubber cap 28 is inserted into the socket mounting hole 2 via a plug socket protective cover 4. In this case, the axial center of the plug socket 20B is automatically aligned with that of the socket mounting hole 2, because the ribs 28*b* formed on the outer circumference of the lower rubber cap 28 is brought into contact with the inner circumference of the socket protective cover 4. Therefore, it is possible to securely insert the plug terminal 7 of the ignition plug 1 into the small-diameter central hole 28*a* of the lower rubber cap 28. In this embodiment, it is preferable to form the socket protective cover 4 in such a way that the outer diameter thereof is tapered toward the lower direction with a taper angle of about 1 to 3 degrees, because the lower rubber cap 28 can be easily inserted into the upper end portion of the socket protective cover 4.

Figure 3A:
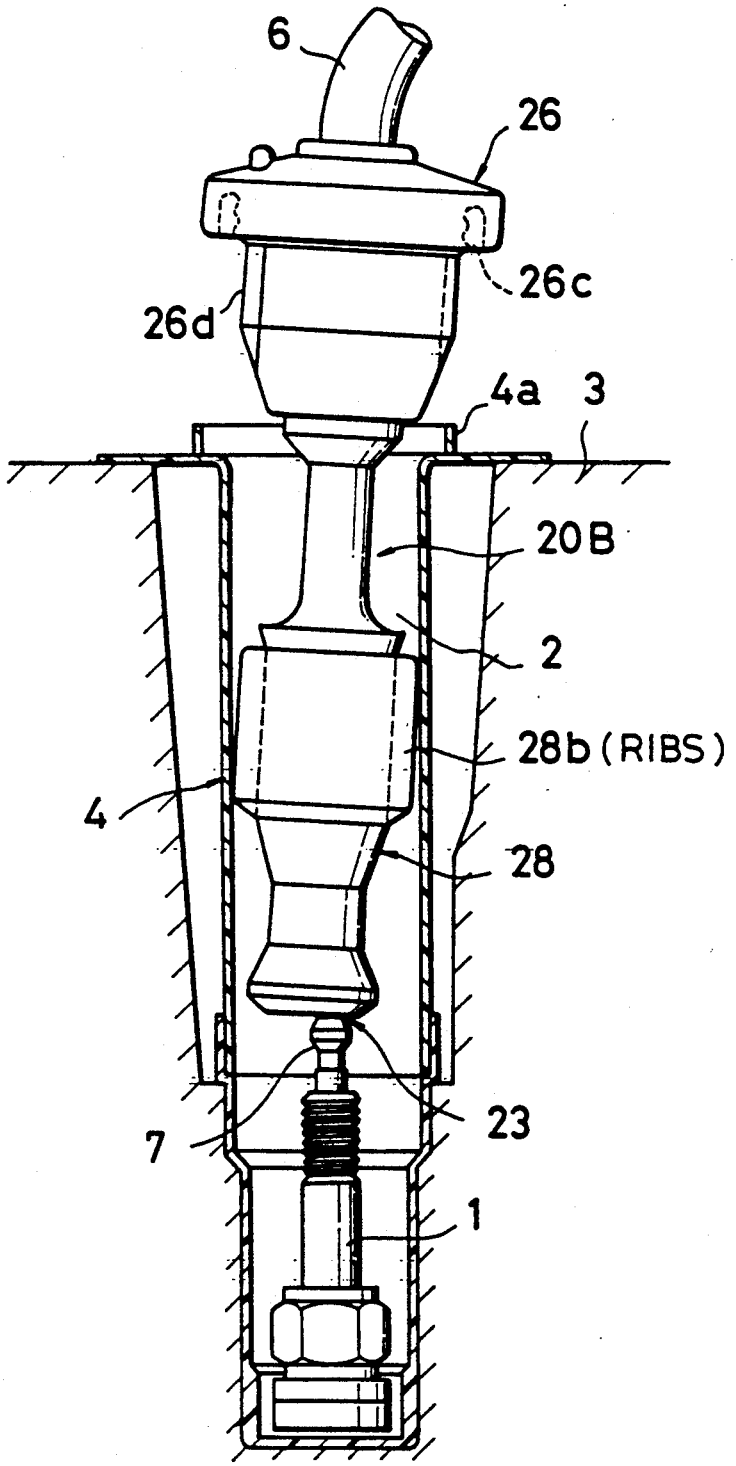
FIG. 3(A) is a side, partially cross-sectional view for assistance in explaining the effect of the first embodiment.
Figure 3B:
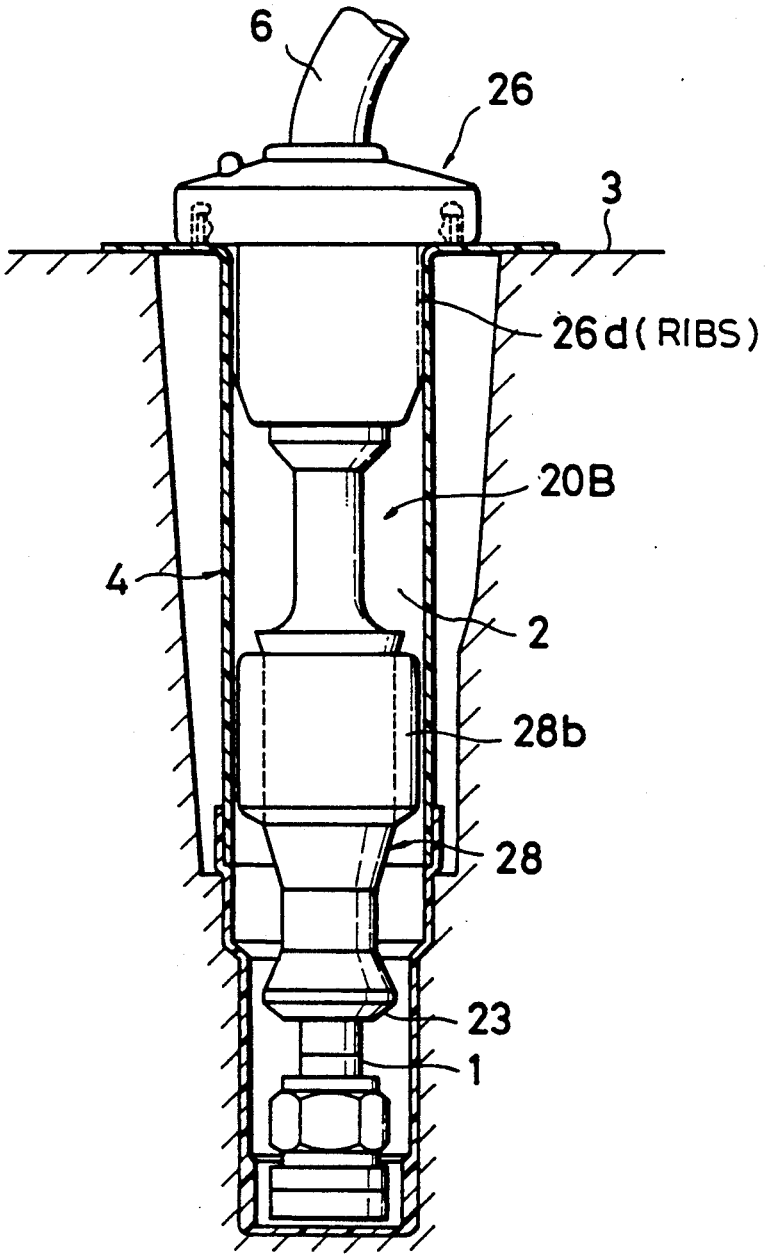
FIG. 3(B) is a similar side, partially cross-sectional view for assistance in explaining the effect of the first embodiment.

In addition, as shown in FIG. 3(B), after the socket contactor 23 of the socket terminal 21 has been brought into contact with the plug terminal 7 of the ignition plug 1, since the ribs 26*d* formed on the outer circumference of the upper rubber cap 28 are next brought into contact with the inner circumference of the socket protective cover 4, it is possible to easily engage the fitting groove 26*c* formed in the upper rubber cap 26 with the circular projection 4*a* (shown in FIG. 3(A) of the socket protective cover 4. After the plug socket 20B has been completely inserted into the socket protective cover 4, since the plug socket 20B is supported within the socket protective cover 4 by the upper and lower axially extending straight ribs 26*d* and 28*b*, it is possible to effectively prevent the plug socket 20B from being vibrated when the engine is running or the vehicle is travelling.

Figure 4:
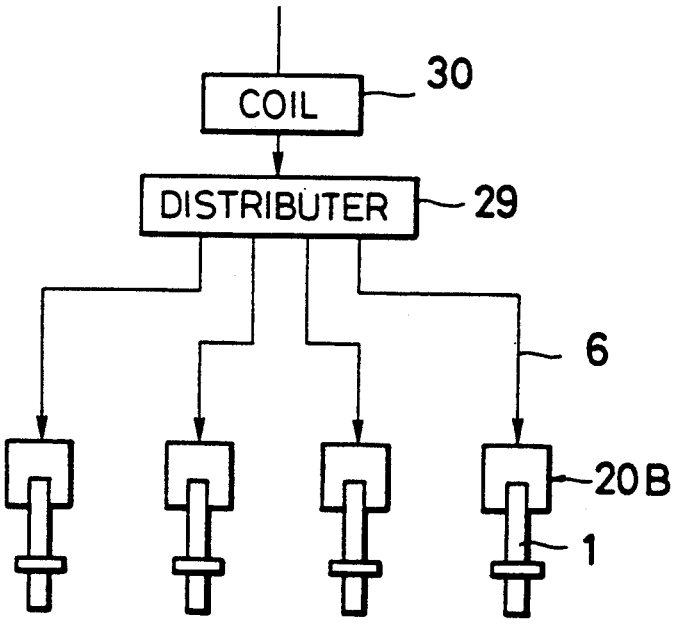
FIG. 4 is a wiring diagram when a plurality of ignition plug sockets of the first embodiment are connected to a high tension generating coil.

FIG. 4 shows a wiring diagram of an ignition system, in which a high tension (high voltage) generated by an ignition coil 30 is applied to a distributer 29 for supplying a high tension at appropriate timing to a plurality of ignition plugs 1 via a plurality of high tension cords 6 and a plurality of the plug sockets 20B of the present invention.

As described above, in the plug socket 20B according to the present invention, since the upper and lower rubber caps 26 and 28 are formed with a plurality of axially extending straight ribs **26*d* and 28*b*, respectively, when the plug socket 20B is inserted into the socket mounting hole 2 via the socket protective cover 4, it is possible to easily align the axial center of the plug socket 20B with that of the ignition plug 1 because the ribs 26*d* and 28*b* are guided in contact with the inner circumference of the socket protective cover 4. In addition, after the plug socket 20B has been mounted, since these ribs 26*d* and 28*d* are kept in contact with the socket protective cover 4, it is possible to protect the plug socket 20B** from engine or vehicle vibration.

Figure 5A:
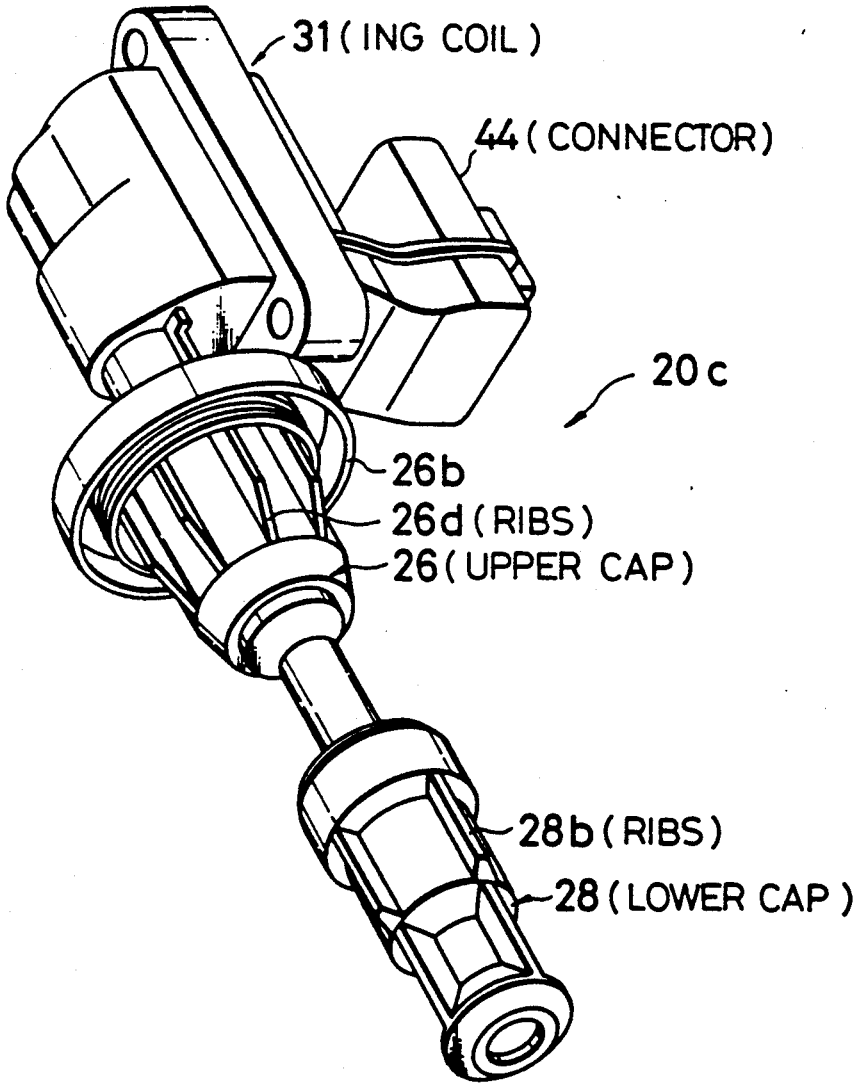
FIG. 5(A) is a perspective view showing a second embodiment of the ignition plug socket according to the present invention.

FIGS. 5(A) and (B) show a second embodiment of the ignition plug socket 20C according to the present invention, in which an ignition coil 31 and a coil connector 44 are mounted on the ignition plug socket **20*c*** instead of a high tension cord.

Figure 5B:
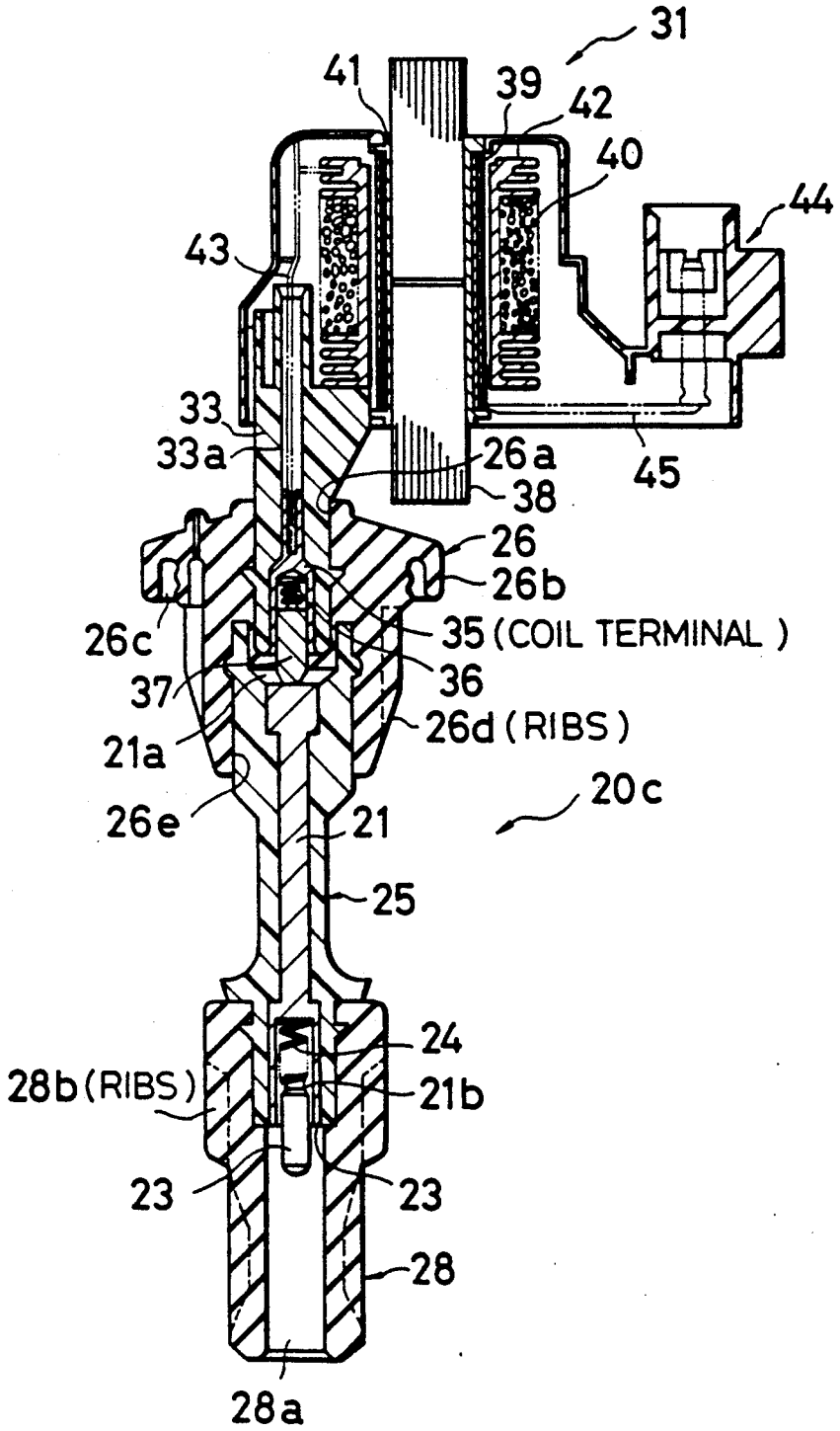
FIG. 5(B) is a longitudinal cross-sectional view showing the second embodiment shown in FIG. 5(A)

In FIG. 5(B), a coil support member 33 made of an insulating resin is inserted into the small diameter central hole **26*a* of the upper rubber cap 26, and a coil terminal 35 formed with a lower hollow portion is inserted into a central hole 33*a* of the coil support member 33. A coil contactor 37 is supported by a spring 36 within the lower hollow portion of the coil terminal 35 so as to be brought into contact with the socket terminal 21**.

On the other hand, the ignition coil 31 comprises an iron core 38, a primary coil 39 wound around an inner coil bobbin 41, and a secondary coil 40 wound around an outer coil bobbin 42. Further, the primary coil 39 is connected to a coil connector 44 attached to the coil support member 33 via a wire 45, and the secondary coil 40 is connected to the coil terminal 35 inserted within the coil support member 33 via a wire 43.

The structural features and functional effects of this second embodiment **20*c* other than those described above are substantially the same as with the first embodiment 20B** previously described, and therefore the reference numerals have been retained for similar parts which have the same functions, without any detailed description of them.

Figure 6:
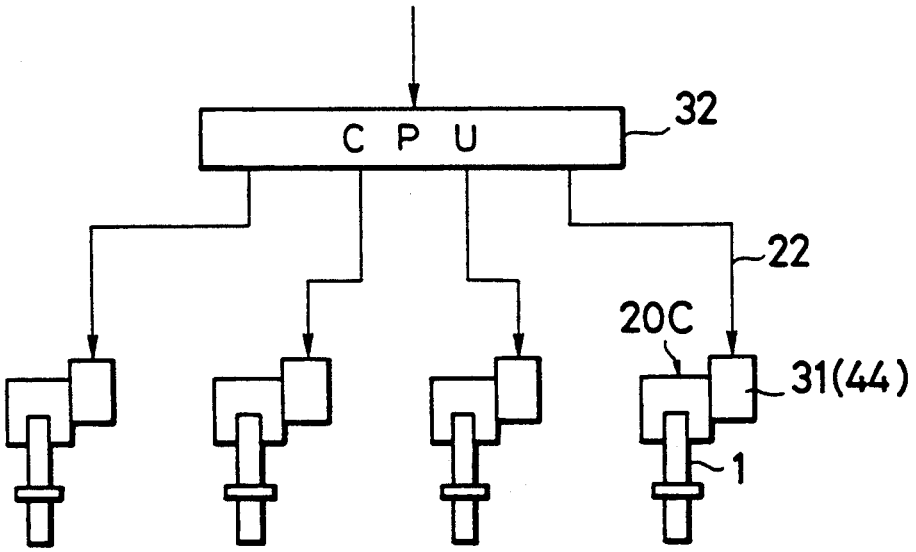
FIG. 6 is a wiring diagram when a plurality of ignition plug sockets of the second embodiment are connected to a CPU.

FIG. 6 shows a wiring diagram of another ignition system, in which the connectors 44 of the ignition coils 31 mounted on the ignition plug sockets 20C, respectively are connected to a CPU 32 via cords 22. Therefore, when a low voltage is supplied from the CPU 32 to the primary coil 39, a high tension is generated by the secondary coil 40 and supplied to the ignition plug 1 through the plug socket 20C.

Since the axially extending straight ribs **26*d* and 28*b* are formed integral with the upper rubber cap 26 and the lower rubber cap 28**, respectively, it is possible to obtain the same effects of easy plug socket alignment with the socket mounting hole and plug socket vibration prevention.

Figure 7:
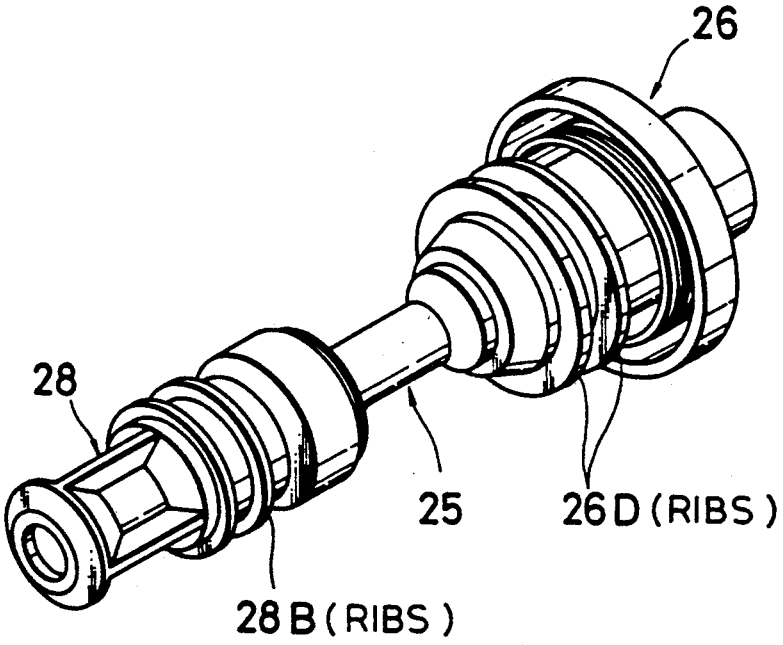
FIG. 7 is a perspective views showing another embodiment of the ignition plug socket according to the present invention.

FIG. 7 shows another embodiment of the ignition plug socket according to the present invention, in which two circumferentially extending annular ribs 26D are formed in the upper rubber cap 26 and similar two circumferentially extending annular ribs 28B are formed in the lower rubber cap 28. In this embodiment, it is possible to obtain substantially the same effect of easy plug socket alignment with the socket mounting hole and plug socket vibration prevention, as with the first and second embodiments.

As described above, in the ignition plug socket structure according to the present invention, since the plug socket body is formed with axially or circumferentially extending projection portions on the upper and lower rubber caps as a socket mounting guide when the plug socket is mounted on the engine body and further as a socket supporting member when the engine is vibrated, it is possible to facilitate mounting of the ignition plug socket into the engine body and additionally to prevent vibration of the mounted plug socket during engine running and/or vehicle travelling.

What is claimed is:

1. An ignition plug socket structure mounted on an engine body, for connecting an ignition coil to an ignition plug, comprising:

(a) a cylindrical plug socket protective cover disposed in an ignition plug socket mounting hole formed in an engine body; and (b) an ignition plug socket having:

(1) a resin plug socket body for holding a plug socket terminal therewithin;

(2) an elastic upper cap attached to an upper end of said socket body and formed with a first plurality of axially extending outer straight ribs brought into contact with an inner circumferential surface of said plug socket protective cover; and (3) an elastic lower cap attached to a lower end of said socket body and formed with a second plurality of axially extending outer straight ribs separate from said first plurality of ribs and also brought into contact with the inner circumferential surface of said plug socket protective cover, whereby said ignition plug socket can be aligned with the ignition plug socket mounting hole and protected from engine vibration.

2. The ignition plug socket structure of claim 1, which further comprises:

(a) an ignition coil mounted on said ignition plug socket; and (b) a coil connector mounted on said ignition coil.

3. The ignition plug socket structure of claim 1, wherein the plug socket protective cover is formed being tapered from an external side to an internal side of the engine body.

4. The ignition plug socket structure of claim 4, wherein a taper angle of the plug socket protective cover is from 1 to 3 degrees.

* * * * *

UNITED STATES PATENT AND TRADEMARK OFFICE

CERTIFICATE OF CORRECTION

PATENT NO. : 5,026,294

DATED : June 25, 1991

INVENTOR(S) : MASAHIRO HISATOMI et al

It is certified that error appears in the above-identified patent and that said Letters Patent is hereby corrected as shown below:

Claim 4, line 1, "claim 4," should be --claim 1,--.

Signed and Sealed this

Third Day of November, 1992

*Attest:*

DOUGLAS B. COMER

*Attesting Officer*

*Acting Commissioner of Patents and Trademarks*